US008096790B2

(12) United States Patent
Sadatomi et al.

(10) Patent No.: US 8,096,790 B2
(45) Date of Patent: Jan. 17, 2012

(54) OIL PUMP RESONATOR

(75) Inventors: Masashi Sadatomi, Gunma-ken (JP); Takatoshi Watanabe, Gunma-ken (JP)

(73) Assignee: Yamada Manufacturing Co., Ltd., Kiryu-shi, Gunma-ken (JP)

( * ) Notice: Subject to any disclaimer, the term of this patent is extended or adjusted under 35 U.S.C. 154(b) by 700 days.

(21) Appl. No.: 12/289,708

(22) Filed: Oct. 31, 2008

(65) Prior Publication Data

US 2009/0129950 A1 May 21, 2009

(30) Foreign Application Priority Data

Nov. 19, 2007 (JP) ..... 2007-299920

(51) Int. Cl.
*F04B 11/00* (2006.01)

(52) U.S. Cl. ..... 417/540; 417/312

(58) Field of Classification Search ..... 417/312, 417/540

See application file for complete search history.

(56) References Cited

U.S. PATENT DOCUMENTS

| | | | | |
|---|---|---|---|---|
| 6,095,773 | A | 8/2000 | Merz | |
| 6,234,758 | B1 | 5/2001 | Pawelski | |
| 2005/0106044 | A1 | 5/2005 | Ohnishi et al. | |
| 2008/0318618 | A1 * | 12/2008 | Park | 455/550.1 |

FOREIGN PATENT DOCUMENTS

| | | | |
|---|---|---|---|
| DE | 196 35 801 | A1 | 5/1998 |
| DE | 102004045100 | A1 * | 3/2006 |
| DE | 10 2005 028 562 | | 10/2006 |
| GB | 2 022 690 | | 12/1979 |
| JP | 55-62875 | | 4/1980 |
| JP | 57-127991 | | 8/1982 |
| JP | 61-41874 | | 3/1986 |
| JP | 4-128573 | | 4/1992 |
| JP | 4-84890 | | 7/1992 |
| JP | 09-060785 | | 3/1997 |
| JP | 10-159719 | | 6/1998 |
| JP | 2006-46150 | | 2/2006 |
| JP | 2007-16697 | | 1/2007 |

* cited by examiner

*Primary Examiner* — Nimeshkumar Patel
*Assistant Examiner* — Glenn Zimmerman
(74) *Attorney, Agent, or Firm* — McGinn IP Law Group, PLLC

(57) ABSTRACT

The invention provides an oil pump resonator in which various vibrations caused by pulsations that change in response to changes in oil pressure on a discharge port side can be attenuated by a resonator that comprises only one chamber, whereby the volume occupied by the resonator can be minimized. An oil pump in an engine, for feeding oil from a suction port to a discharge port through rotation of a rotor fitted in a pump housing, includes: a discharge flow channel communicating with the discharge port; a resonator comprising an introduction channel formed in the discharge flow channel and a chamber communicating with the introduction channel; and a piston having a leading end face section that makes up an inner wall face of the chamber, and reciprocating in response to pulsation changes. The piston slides so as to reduce the volume of the chamber as the frequency distribution of the pulsations becomes higher.

17 Claims, 12 Drawing Sheets

OIL PUMP RESONATOR

BACKGROUND OF THE INVENTION

1. Field of the Invention

The present invention relates to an oil pump resonator in which various vibrations caused by pulsations that change in response to changes in oil pressure on a discharge port side can be attenuated by a resonator that comprises only one chamber, whereby the volume occupied by the resonator can be minimized.

2. Description of the Related Art

Means for reducing pump discharge pulsations in oil pumps comprising an internal gear structure such as a rotor or thelike provided in a pump housing, include, for instance, forming a portion, called a resonator, at a discharge port or midway along a discharge flow channel that communicates with the discharge port. The resonator comprises a communicating channel that communicates with the discharge port, and a chamber (a space of given volume). The pulsations entering the chamber of the resonator are reflected into pulsations having exactly a reverse phase of the pulsations that travel along the flow channel, as a result of which these pulsations traveling along the flow channel are cancelled. This allows reducing pulsations of a specific frequency range. During driving, therefore, the driver experiences no discomfort arising from gradually increasing vibration and noise, perceptible by the driver, as engine revolutions increase.

In actuality, however, there may exist resonance point at any site or location. There exist also at a plurality of points resonance frequencies for which pulsations increase peak-like at specific frequencies. When the above pulsation peaks exist, first of all vibration and noise perceptible by the driver do not change smoothly in response to changes in revolutions, and hence the driver experiences discomfort during the driving operation. Secondly, the pulsation peak values at resonance frequencies are far larger than the magnitude of the pulsations at other frequencies. The presence of pulsation peak values, therefore, drives up considerably the overall magnitude of pulsations. Such peak frequencies, moreover, do not occur at one single point, but at plural sites. Japanese Patent Application Laid-open No. 2007-16697, for instance, discloses a method for reducing pulsation peaks of plural frequencies.

The frequencies of the pulsations that the resonator is capable of reducing can be adjusted on the basis of the volume of the resonator. More specifically, a resonator having a larger volume allows reducing pulsations of lower frequencies, while a resonator having a smaller volume allows reducing pulsations of higher frequencies. Such being the case, Japanese Patent Application Laid-open No. 2007-16697 provides a plurality of oil chambers, of dissimilar volume, communicating with a discharge channel of an oil pump, making it possible thereby to reduce pulsations of frequencies identical to those of the oil chambers.

However, the oil pump in Japanese Patent Application Laid-open No. 2007-16697 has the following problems. Firstly, it is necessary to provide as many oil chambers as there are frequency points for which pulsations are to be reduced. In case of multiple frequencies for which pulsations are to be reduced, however, providing multiple oil chambers may be impossible in practice, in terms of engine layout, while there are obvious limits to the number of oil chambers that can be arranged. Secondly, the volume occupied by the plurality of oil chambers that must be arranged becomes extremely large (oil chamber volume×number of chambers).

Thirdly, although pulsations can be reduced for a number of frequency points corresponding to the number of oil chambers that are provided, the frequencies that can be reduced are point frequencies, and thus pulsations of frequencies deviating from these points cannot be reduced.

SUMMARY OF THE INVENTION

More specifically, the frequencies of pulsations that can be reduced are determined by the volume of the oil chamber. In Japanese Patent Application Laid-open No. 2007-16697, however, the volumes of the oil chambers are fixed, and hence the frequencies of the pulsations that can be reduced are also fixed. In the light of the above, providing a resonator having multiple chambers in an engine room, where space is limited, is rarely feasible. Moreover, there remain frequencies for which the resonator is ineffective, namely frequencies lying outside the narrow range of frequencies for which the effect of the resonator can be brought out. It is thus an object (technical problem) of the present invention to provide a space-saving resonator structure in which the volume occupied by the resonator is kept at a minimum while allowing reducing pulsations across a wide range of frequencies.

The invention of claim 1 solves the above problems with an oil pump resonator, in an engine oil pump for feeding oil from a suction port to a discharge port through rotation of a rotor fitted in a pump housing, provided with: a discharge flow channel communicating with the discharge port; a resonator comprising an introduction channel formed in the discharge flow channel, and a chamber communicating with the introduction channel; and a piston having a leading end face section that makes up an inner wall face of the chamber, and reciprocating in response to pulsation changes, the piston being configured to slide so as to reduce the volume of the chamber as the frequency distribution of the pulsations becomes higher.

The invention of claim 2 solves the above problems with an oil pump resonator, in an engine oil pump for feeding oil from a suction port to a discharge port through rotation of a rotor fitted in a pump housing, provided with: a discharge flow channel communicating with the discharge port; a resonator comprising an introduction channel formed in the discharge flow channel, and a chamber communicating with the introduction channel; and a piston having a leading end face section that makes up an inner wall face of the chamber, and sliding on the basis of detected revolutions of the engine, the piston being configured to slide so as to reduce the volume of the chamber as the revolutions of the engine increase.

The invention of claim 3 solves the above problems with an oil pump resonator, in an engine oil pump for feeding oil from a suction port to a discharge port through rotation of a rotor fitted in a pump housing, provided with: a discharge flow channel communicating with the discharge port; a resonator comprising an introduction channel formed in the discharge flow channel, and a chamber communicating with the introduction channel; and a piston having a leading end face section that makes up an inner wall face of the chamber, and sliding in response to oil pressure changes, the piston being configured to slide so as to reduce the volume of the chamber as oil pressure increases in the discharge flow channel.

The each invention of claim 4, 5 or 6 solves the above problems with an oil pump resonator having the above features, in which a motor causes the piston to reciprocate within the chamber. The each invention of claim 7, 8 or 9 solves the above problems with an oil pump resonator having the above features, in which the motor is operated by an engine rpm sensor. The each invention of claim 10, 11 or 12 solves the above problems with an oil pump resonator having the above features, in which the motor is operated by a pressure sensor that detects pressure in the discharge flow channel. The each invention of claim 13, 14 or 15 solves the above problems with an oil pump resonator having the above features, in which the pressure sensor detects pressure at a position more downstream in the discharge flow channel than an inlet opening of the introduction channel.

The invention of claim 16 solves the above problems with an oil pump resonator having the above features, and comprising a piston chamber adjacent to the chamber, wherein the piston comprises a piston rod having the leading end face section, and a piston base having a rear face section having a larger surface area than the leading end face section, the piston chamber communicating with the discharge flow channel via a branch channel, such that oil pressure acts on the rear face section, and the piston is usually elastically urged in a direction that makes the volume of the chamber larger. The invention of claim 17 solves the above problems with an oil pump resonator having the above features, in which an inlet opening of the branch channel is positioned more downstream in the discharge flow channel than the introduction channel inlet opening.

In the invention of claim 1, discharge oil pulsations can be reduced, over a wide frequency range, using a resonator having one chamber alone, by providing a piston that reciprocates in response to pulsation changes, the piston sliding so as to reduce the volume of the chamber as the frequency distribution of the pulsations becomes higher. In the invention of claim 2 there is provided a piston sliding on the basis of detected revolutions of the engine, the piston sliding so as to reduce the volume of the chamber as the revolutions of the engine increase.

As a result, variation in the measured value of engine revolutions is smaller than variation in the measured value of oil pressure. The measured values are defined unambiguously. Therefore, piston reciprocating is controlled on the basis of measurement information of engine revolutions, which allows as a result modifying or varying the chamber space in accordance with pulsation changes, with high precision. The piston is structured to slide so as to shrink the volume of the chamber, and hence discharge oil pulsations can be reduced, over a wide frequency range, using a resonator having one chamber alone. In terms of frequency, pulsations can be reduced herein over a wide area, and not pinpoint-wise (point positions). As a result, pulsations can be reduced over a wide frequency range.

In particular, one single resonator of the present invention can cope with pulsations of various frequencies. In terms of volume occupied in the pump housing, therefore, the resonator of the present invention affords space savings as compared to providing plural resonators. This space saving effect can become more significant as there increases the number of pulsation frequency points that are to be reduced. Conventionally, there is provided a resonator having as many chambers as there are pulsation peaks. However, the volume occupied by the resonators becomes excessive, as does the size of the pump housing, when the number of pulsation frequency points to be reduced is large and there must be disposed an equal number of corresponding resonators. The inventions of claims 1 and 2 afford substantial space savings in that the single resonator that occupies volume in the pump housing comprises only one chamber, regardless of the number of frequency points of the pulsations to be reduced.

Substantially the same effect as that of the invention of claim 2 is elicited by the invention of claim 3, in which there is provided a piston that slides in response to oil pressure changes, in such a manner so as to reduce the volume of the chamber as oil pressure increases in the discharge flow channel. In the each invention of claim 4, 5 or 6, the piston can be accurately and reliably operated since it is a motor that causes the piston to reciprocate. In claim 7, 8 or 9, the motor operation is controlled by an rpm sensor, and hence the piston can be operated accurately and reliably, so that the piston can reciprocate in a stable manner, accurately and reliably. In the invention of claim 10, 11 or 12, motor operation is controlled by a pressure sensor, and hence the piston can be operated accurately and reliably, so that the piston can reciprocate in a stable manner. In the each invention of claim 13, 14 or 15, the pressure sensor detects pressure at a position more downstream in the discharge flow channel than an inlet opening of the introduction channel. Therefore, the piston does not incur unwanted behavior on account of pulsations, and thus the reciprocal motion operation of the piston, whereby the volume of the chamber is modified, is made yet more reliable.

In the invention of claim 16 a piston chamber is communicatingly provided adjacent to the above chamber, and the piston comprises a piston rod having the leading end face section, and a piston base having a rear face section having a larger surface area than the leading end face section. The piston chamber communicates with the discharge flow channel via a branch channel, such that oil pressure acts on the rear face section. The piston operates thereby extremely stably, with high responsiveness to pressure changes. The structure of the resonator can be made very simple by providing the branch channel at part of the discharge flow channel, the branch channel simply communicating with the discharge flow channel and the piston chamber. The piston is usually elastically urged, by a spring or the like, in a direction that makes the volume of the chamber larger. Therefore, the chamber can expand when oil pressure is low, and shrink when oil pressure is high, making for an even simpler resonator structure.

In the invention of claim 17, the inlet opening of the branch channel is positioned more downstream in the discharge flow channel than the introduction channel inlet opening. As a result, pulsations are reduced downstream of the position at which the resonator is disposed, whereby the piston can operate yet more reliably, since the piston does not incur unwanted behavior on account of pulsations.

DESCRIPTION OF THE PREFERRED EMBODIMENTS

Figure 1A:
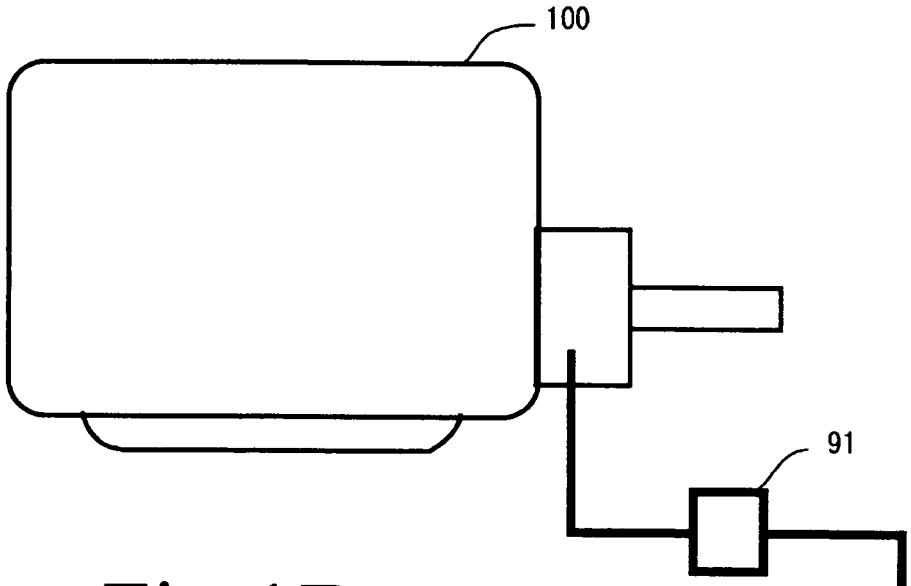
FIG. 1 is a schematic diagram illustrating the constitution of a resonator of a first embodiment of the present invention, fitted in a pump housing.
Figure 1B:
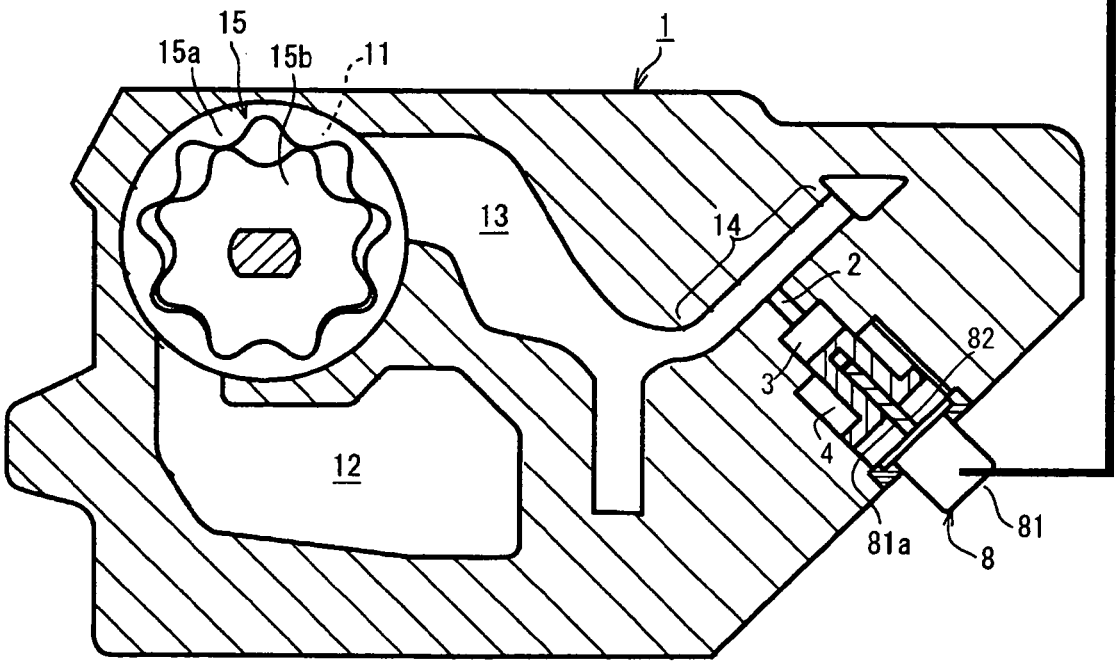

A first embodiment of the various embodiments of the present invention is explained next with reference to FIGS. 1 to 5. As illustrated in FIG. 1, a pump housing 1 has formed therein a rotor chamber 11, a suction port 12 and a discharge port 13. A rotor is disposed in the rotor chamber 11. Specifically, the rotor comprises two toothed rotors 15 that make up an internal-type gear mechanism. The present invention, which corresponds to a type of pump having an internal gear structure and in which suction and discharge are carried out through increase and decrease of cell volume, is effective for flow in which pulsations occur, and can hence be widely used not only in rotors but also in gear pumps in general. A discharge flow channel 14 is communicatingly formed in the discharge port 13. Oil or the like is discharged out of the pump housing 1 via the discharge flow channel 14, to thereby feed oil to other devices.

Figure 3A:
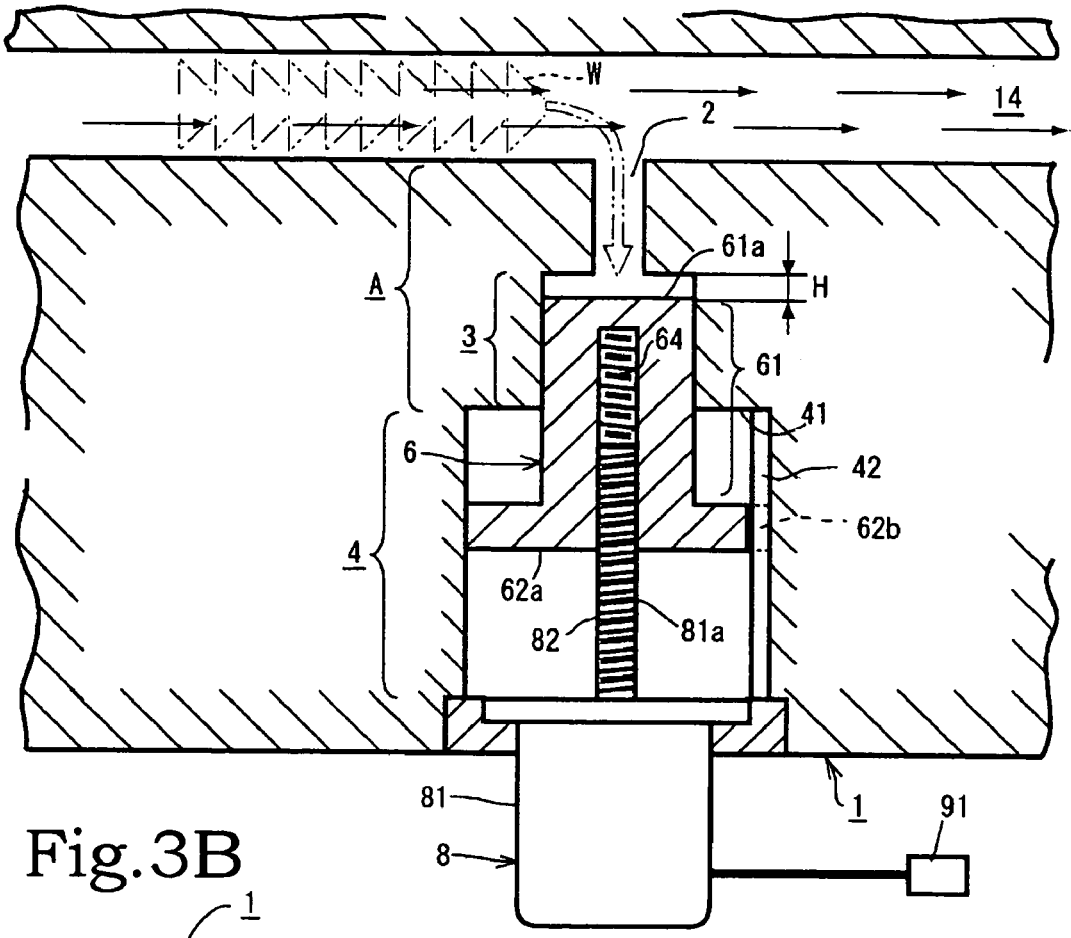
FIG. 3A is a vertical cross section front-view diagram of the first embodiment, illustrating the resonator of the first embodiment when oil having a pulsation of a highest frequency flows into a discharge flow channel.
Figure 3B:
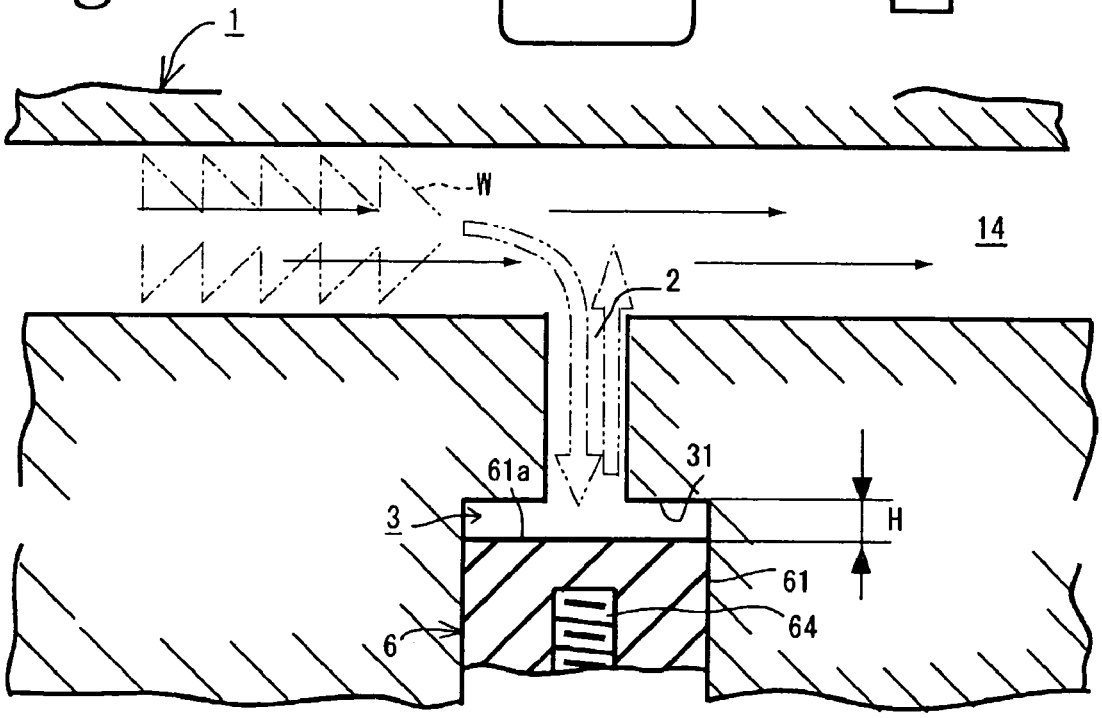
FIG. 3B is an enlarged-view diagram of a characterizing portion of FIG. 3A.
Figure 4A:
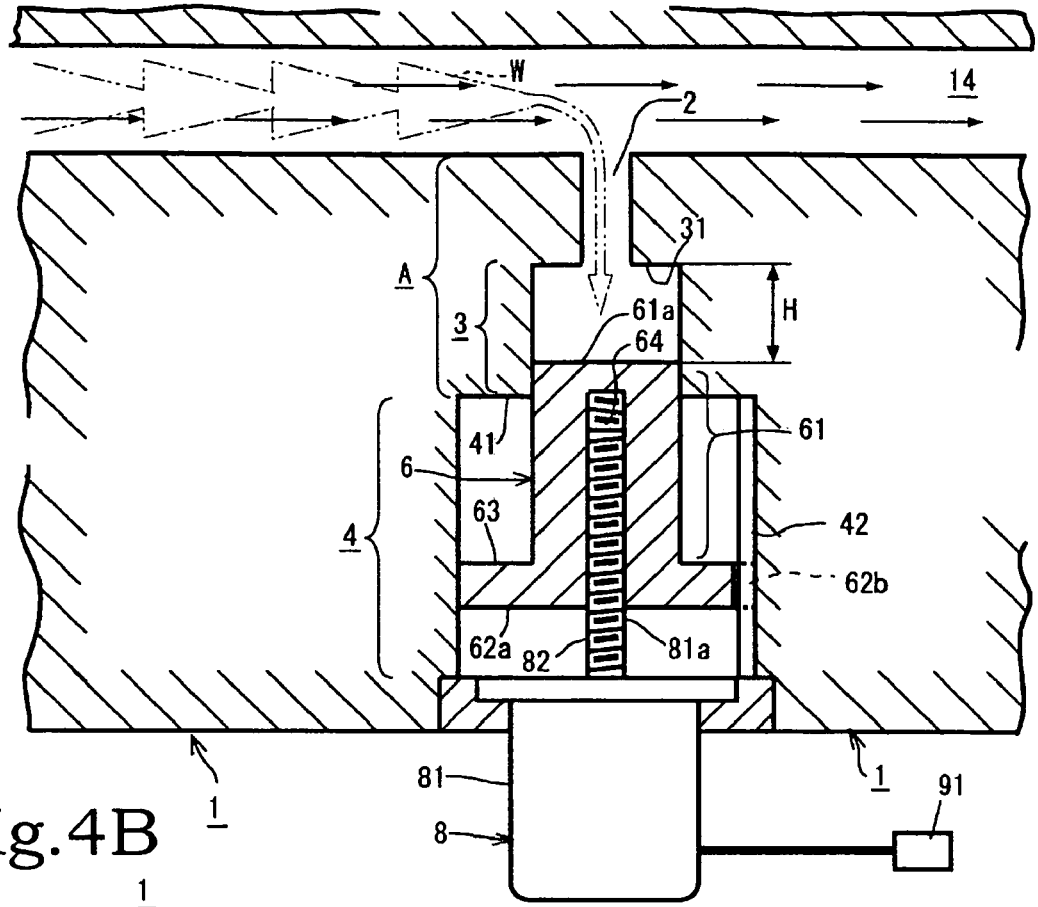
FIG. 4A is a vertical cross section front-view diagram of the first embodiment, illustrating the resonator of the first embodiment when oil having a pulsation of a lowest frequency flows into the discharge flow channel.
Figure 4B:
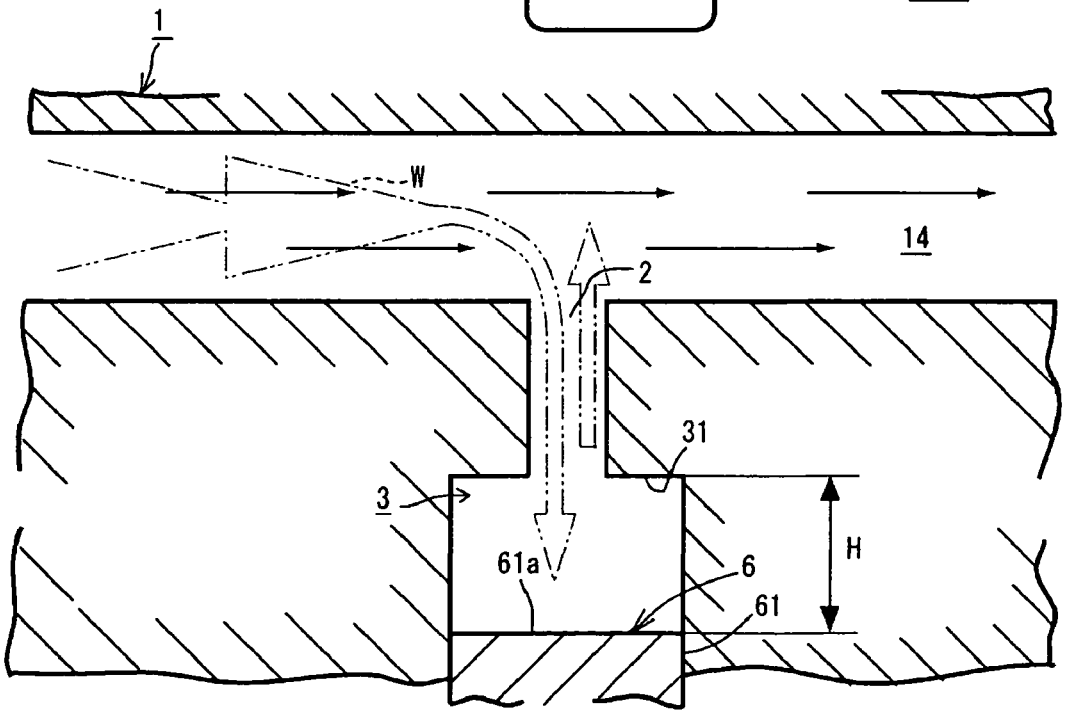
FIG. 4B is an enlarged-view diagram of a characterizing portion of FIG. 4A.
Figure 5A:
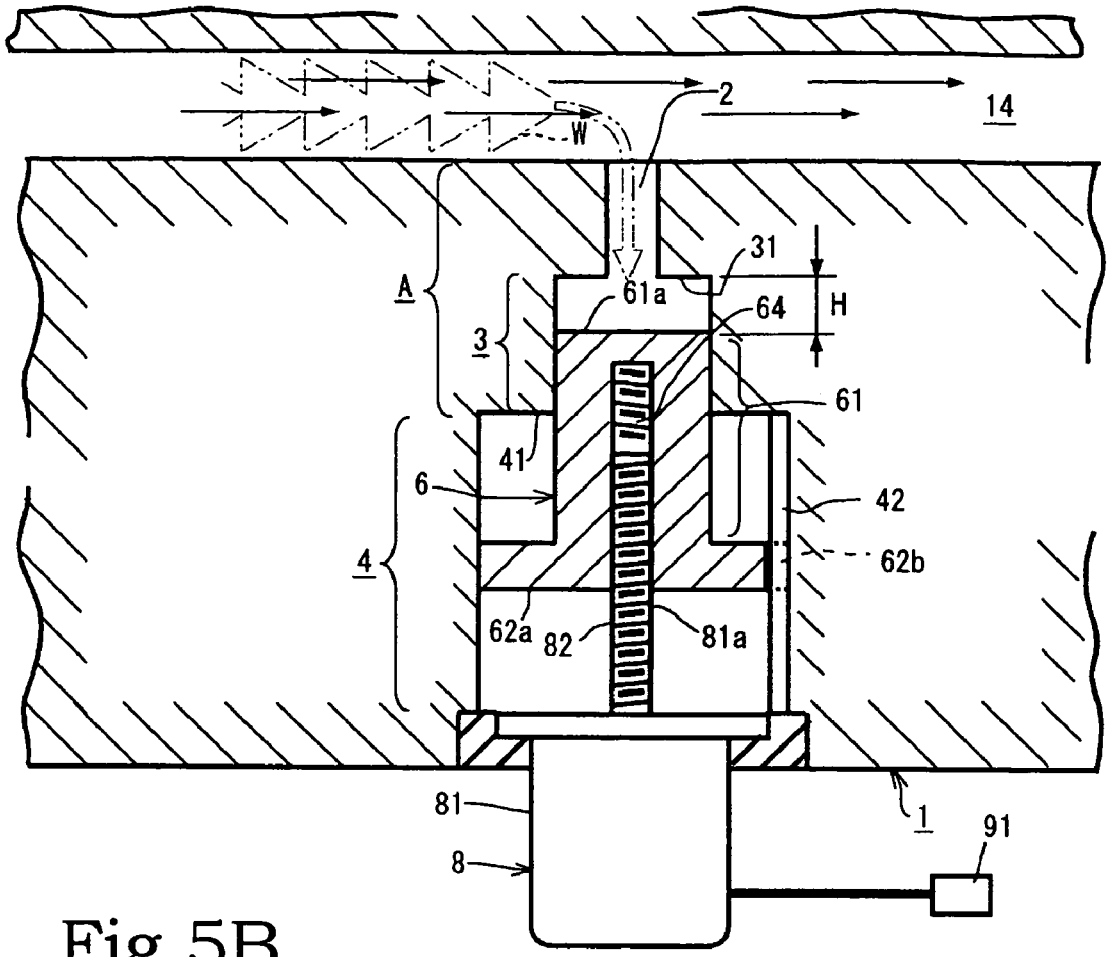
FIG. 5A is a vertical cross section front-view diagram of the first embodiment, illustrating the resonator of the first embodiment when oil having a pulsation of an intermediate frequency (frequency laying between the highest frequency and the lowest frequency) flows into the discharge flow channel.
Figure 5B:
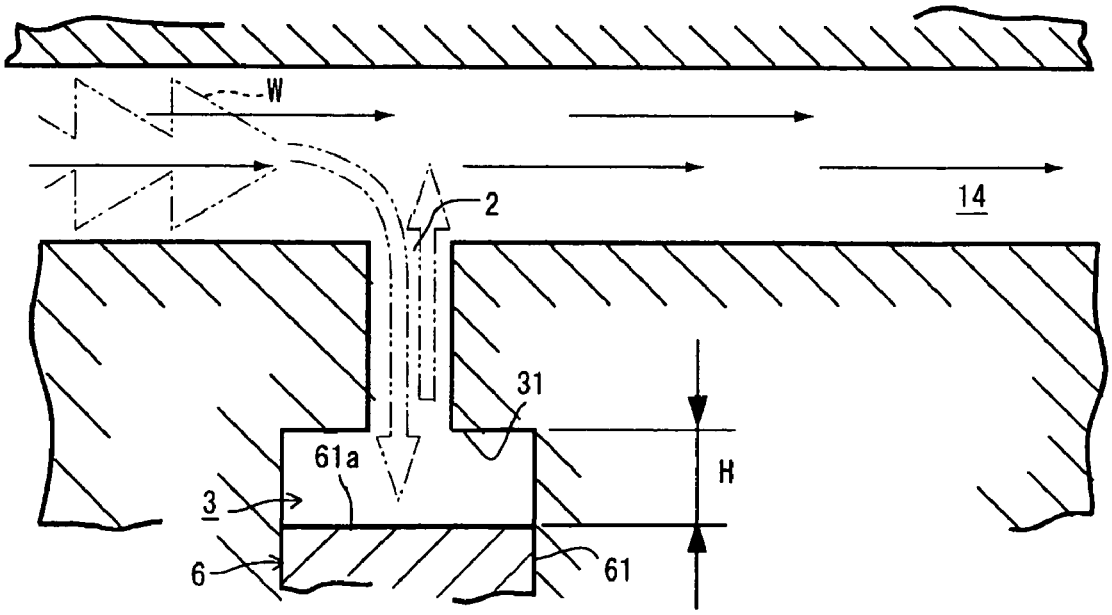
FIG. 5B is an enlarged-view diagram of a characterizing portion of FIG. 5A.

A resonator A is provided in an appropriate position of the discharge flow channel 14. As illustrated in FIG. 1, the resonator A comprises an introduction channel 2 formed in the discharge flow channel 14 that communicates with the discharge port 13, and a chamber 3 communicating with the introduction channel 2. The introduction channel 2 has the role of introducing into the chamber 3 part of the oil flowing through the discharge flow channel 14. The chamber 3 makes up a gap chamber together with a below-described piston 6. The chamber 3 reflects pulsations W of oil entering into the chamber 3 into pulsations having an opposite phase of the pulsations W of the incoming oil, to cancel thereby the pulsations W of the oil flowing through the discharge flow channel 14 (FIG. 3 to FIG. 5).

A piston 6 is disposed in the chamber 3. The piston 6 makes up one inner wall face of the inner wall faces that constitute the chamber 3. The gap volume of the chamber 3 increases and decreases through reciprocating of the piston 6 within the chamber 3. The piston 6 is structured so as to reciprocate in response to pressure changes in the oil that flows through the discharge flow channel 14. The piston 6 moves in such a manner so as to reduce the volume of the chamber 3 as the pressure of oil in the discharge flow channel 14 increases.

The piston 6 comprises a piston rod 61 and a piston base 62. At the apex side of the piston rod 61 there is formed a flat leading end face section 61*a*, while at the bottom side of the piston base 62 there is formed a rear face section 62*a*. A flat step 63 is formed between the piston rod 61 and the piston base 62. The piston rod 61 and the piston base 62 of the piston 6 are both cylindrical, such that the diameter of the rear face section 62*a* is larger than the diameter of the leading end face section 61*a*. That is, the piston 6 is formed in such a manner that the surface area of the rear face section 62*a* of the piston base 62 is larger than the surface area of the leading end face section 61*a* of the piston rod 61. The piston base 62 is housed in the piston chamber 4, while part of the piston rod 61, including the leading end face section 61*a*, is inserted into the chamber 3.

Both the chamber 3 and the piston chamber 4 form a gap chamber of substantially cylindrical shape similar to the shape of the piston 6. The leading end face section 61*a* of the piston rod 61 of the piston 6 makes one of the inner wall faces of the chamber 3. Sliding of the piston 6 causes the leading end face section 61*a* of the piston rod 61 to move up-and-down within the chamber 3, thereby varying the volume of the chamber 3. A step wall face 41 is formed at the boundary between the piston chamber 4 and the chamber 3, such that the step 63 of the piston 6 faces the step wall face 41.

Figure 2A:
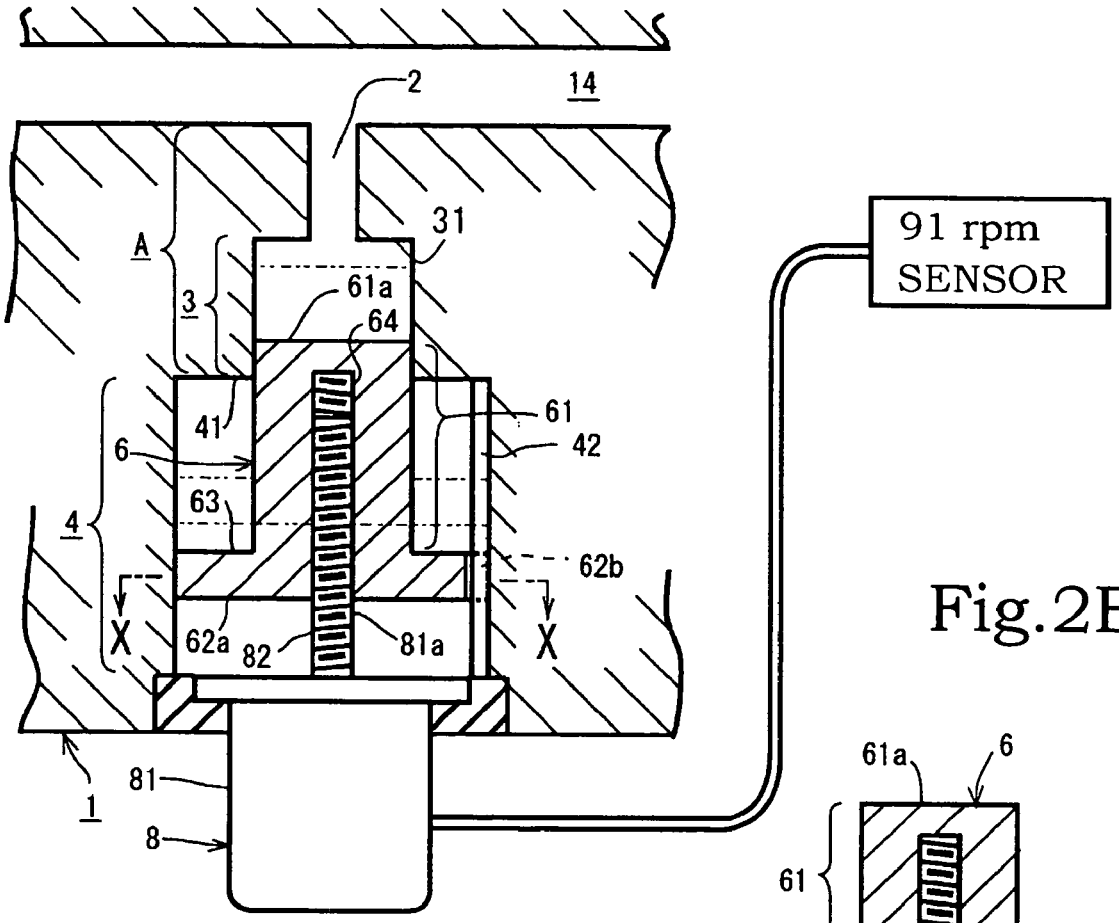
FIG. 2A is a vertical cross-section front-view diagram illustrating the constitution of the first embodiment of the resonator of the present invention.

The piston 6 is structured so as to reciprocate in response to pulsation changes of the oil flowing through the discharge flow channel 14. As the frequency distribution of the pulsations becomes higher, the piston 6 comes into operation, sliding so as to reduce the volume of the chamber 3. In the first embodiment, the piston 6 is structured to reciprocate on account of the pulsations of the oil that flows through the discharge flow channel 14, the piston 6 being caused to slide on the basis of detected revolutions of an engine 100 (FIGS. 1 to 5). As illustrated in FIGS. 1 and 2, the piston 6 that makes up the inner wall face of the chamber 3 reciprocates through the action of a motor 8.

Figure 2B:
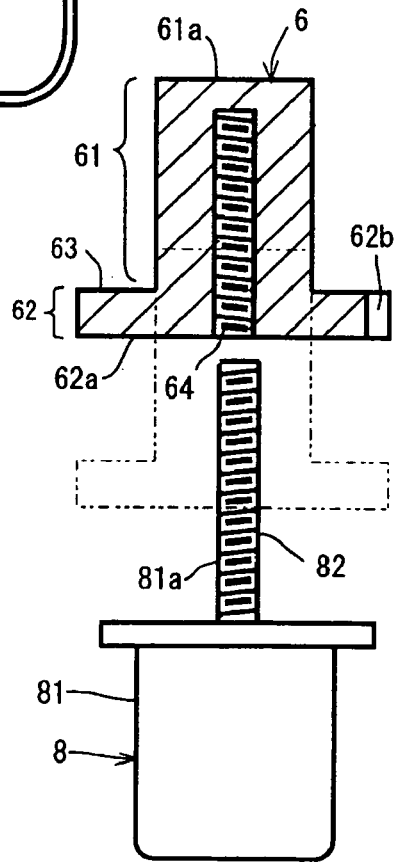
FIG. 2B is a side-view diagram of a motor and a piston in cross section.
Figure 2C:
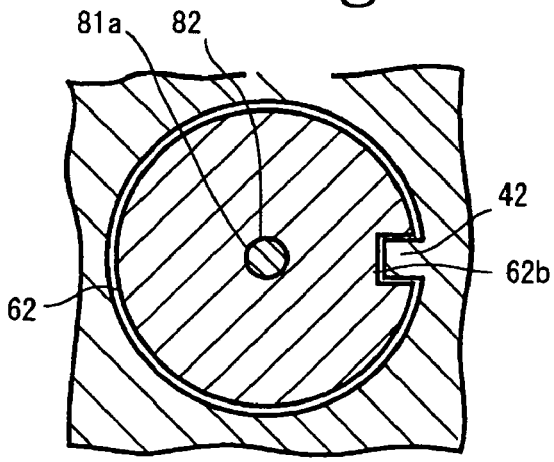
FIG. 2C is a cross-sectional diagram of FIG. 2A viewed from the arrow X-X.

The motor 8 comprises a motor main body 81 and a motor shaft 81*a* having formed thereon a male thread section 82. A female thread section 64 is formed in the piston 6, along the axial direction thereof (FIG. 2B). The male thread section 82 in the motor shaft 81*a* is screwed onto the female thread section 64, such that the piston 6 is displaced in the axial direction of the motor shaft 81*a* as a result of the rotation of the motor shaft 81*a*. A guide rail 42 is formed in the piston chamber 4 so as to prevent idling of the piston 6 when the piston 6 is moved reciprocally, by the motor 8, within the chamber 3. Also, a cutout 62*b*, along which the guide rail 42 is loosely inserted, is formed on the piston base 62 of the piston 6 (FIG. 2C).

The operation of the piston 6 is governed by an rpm sensor 91 that detects the revolutions of the engine 100. The rpm sensor 91 detects the revolutions of the engine 100, and sends relevant information to the motor 8, whereupon the piston 6 reciprocates within the piston chamber 4 and the chamber 3. As the revolutions of the engine 100 increase, the piston 6 slides in such a way so as to reduce the volume of the chamber 3. The measured value of the revolutions of the engine 100 exhibits less variation than the measured value of oil pressure. The measured values are defined unambiguously. The frequency of the pulsations caused by oil in the discharge flow channel 14 corresponds to the revolutions of the engine 100. Therefore, controlling the sliding of the piston 6 on the basis of the measured value of the revolutions of the engine 100 allows modifying, with high precision, the volume of the chamber 3 in response to changes in the pulsations W, and allows further reducing the pulsations W.

Figure 6A:
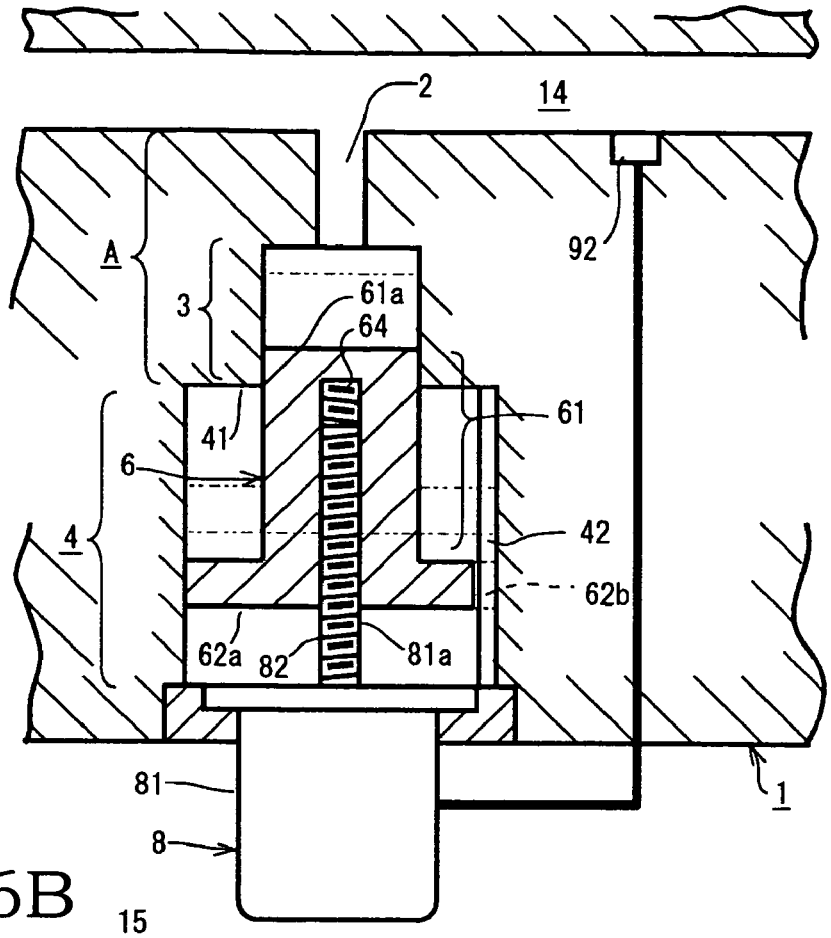
FIG. 6A is a vertical cross-section front-view diagram illustrating the constitution of a second embodiment of a resonator of the present invention.
Figure 6B:
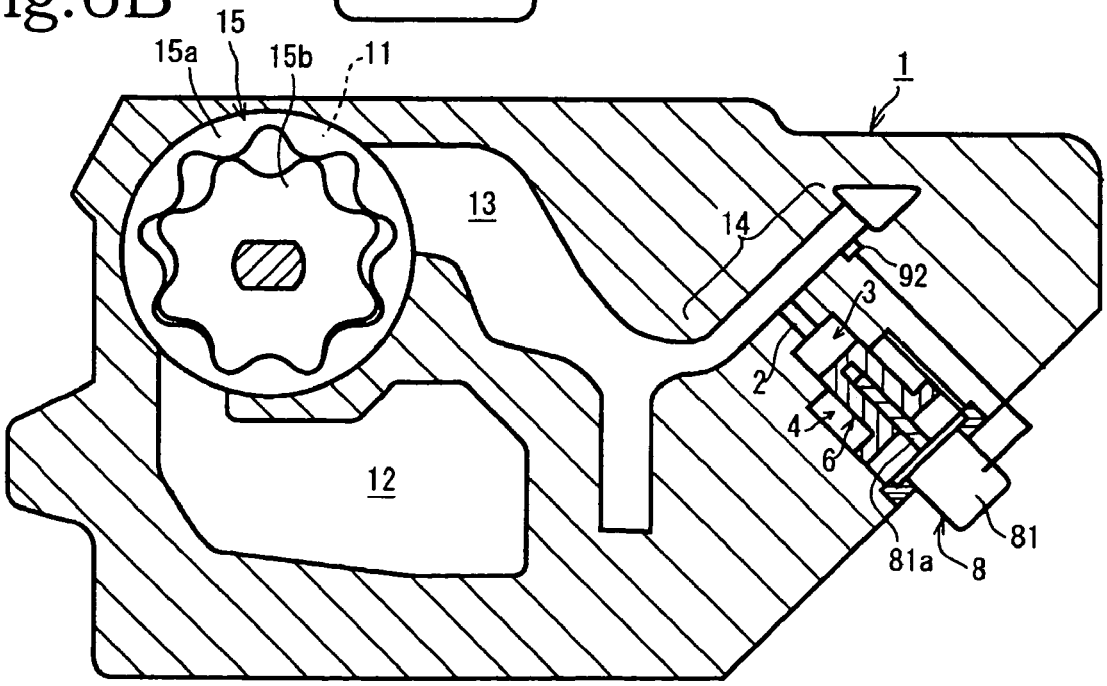
FIG. 6B is a schematic diagram illustrating the constitution of the resonator of the second embodiment when fitted in a pump housing.
Figure 7A:
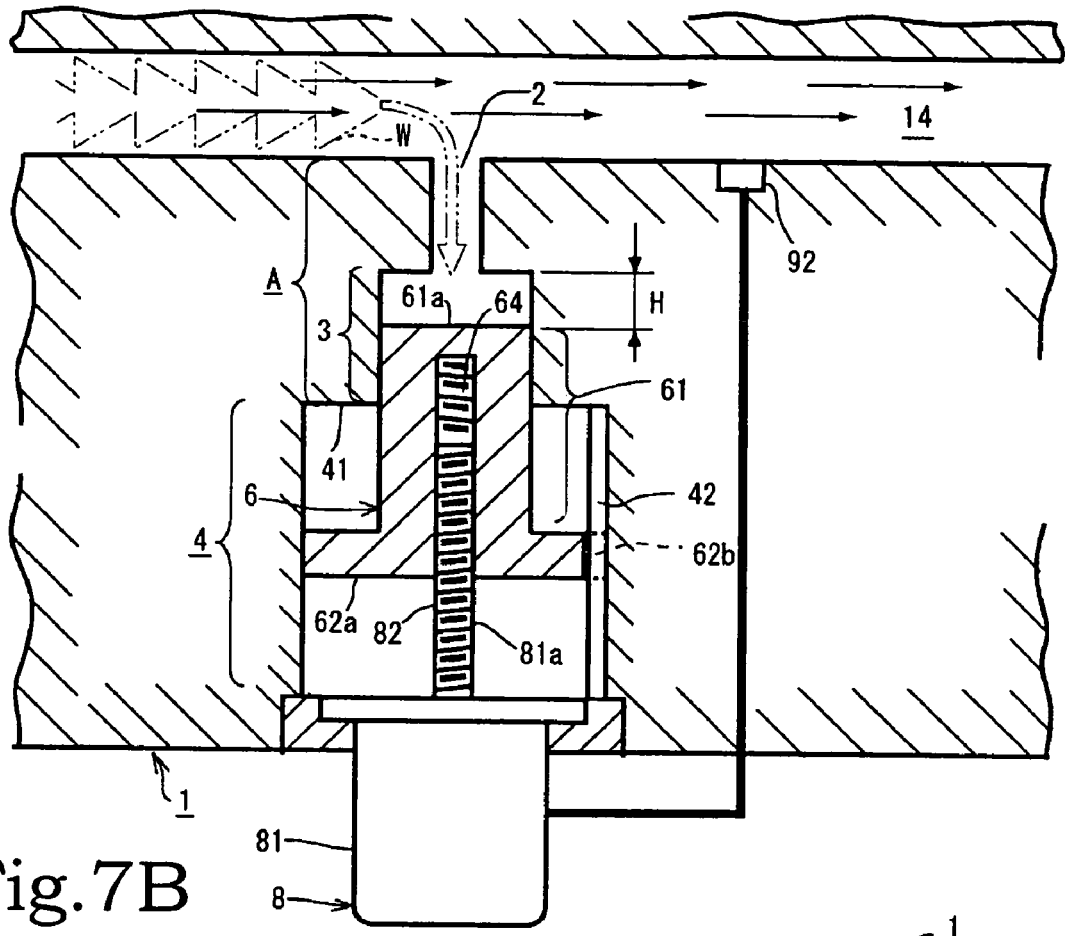
FIG. 7A is a vertical cross section front-view diagram of the second embodiment, illustrating the resonator of the second embodiment when oil having a pulsation of an intermediate frequency flows into a discharge flow channel.
Figure 7B:
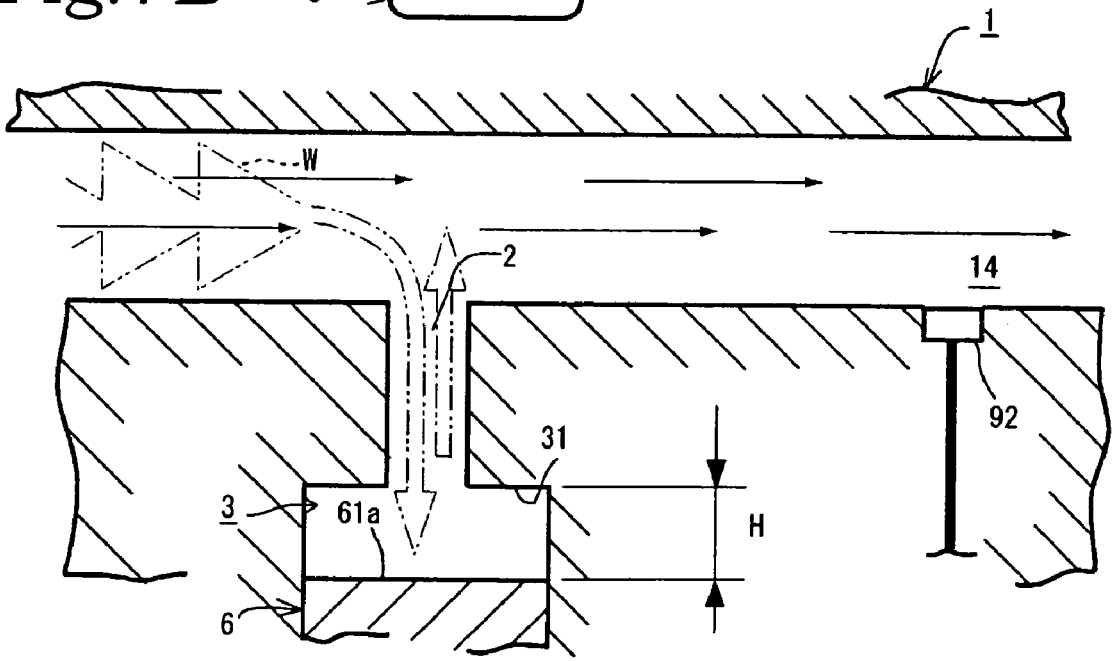
FIG. 7B is an enlarged-view diagram of a characterizing portion of FIG. 7A.

As illustrated in FIGS. 6 and 7, the constitution of a second embodiment of the present invention is substantially identical to that of the first embodiment. In the motor 8 used, the male thread section 82 of the motor shaft 81*a* is screwed onto the female thread section 64 of the piston 6. The piston 6 moves in the axial direction of the motor shaft 81*a* on account of the rotation of the motor shaft 81*a*. Further, a pressure sensor 92 is fitted in the discharge flow channel 14. The role of the pressure sensor 92 is to detect and read the pressure of oil in the discharge flow channel 14, and to transmit a corresponding information signal to the motor 8. Preferably, the pressure sensor 92 is positioned more downstream than the position of the introduction channel 2 of the resonator A (FIGS. 6 and 7).

In a third embodiment, next, the piston chamber 4 is formed adjacent to the chamber 3, as illustrated in FIGS. 8 through 11. The piston chamber 4, which houses the piston 6, is a space within which the piston 6 slides. Specifically, the piston 6 is built so as to be capable of reciprocating across both the chamber 3 and the piston chamber 4. A branch channel 5 is formed between the discharge flow channel 14 and the piston chamber 4, such that the discharge flow channel 14 and the piston chamber 4 communicate with each other via the branch channel 5. The branch channel 5 is formed as a channel having a smaller inner diameter than the discharge flow channel 14. The role of the branch channel 5 is to feed the pressure of the discharge flow channel 14 into the piston chamber 4.

The structure and shape of the piston 6 is substantially identical to that of the first embodiment. As illustrated in FIG. 8, the piston 6 comprises a piston rod 61 and a piston base 62. At the apex side of the piston rod 61 there is formed a flat leading end face section 61*a*, while on the bottom side of the piston base 62 there is formed a rear face section 62*a*. A flat step 63 is formed between the piston rod 61 and the piston base 62. The piston rod 61 and the piston base 62 of the piston 6 are both cylindrical, and are shaped in such a manner that the diameter of the rear face section 62*a* is larger than the diameter of the leading end face section 61*a*. That is, the piston 6 is formed in such a manner that the surface area of the rear face section 62*a* is larger than the surface area of the leading end face section 61*a*. The piston base 62 is housed in the piston chamber 4, while part of the piston rod 61, including the leading end face section 61*a*, is inserted into the chamber 3.

Figure 8A:
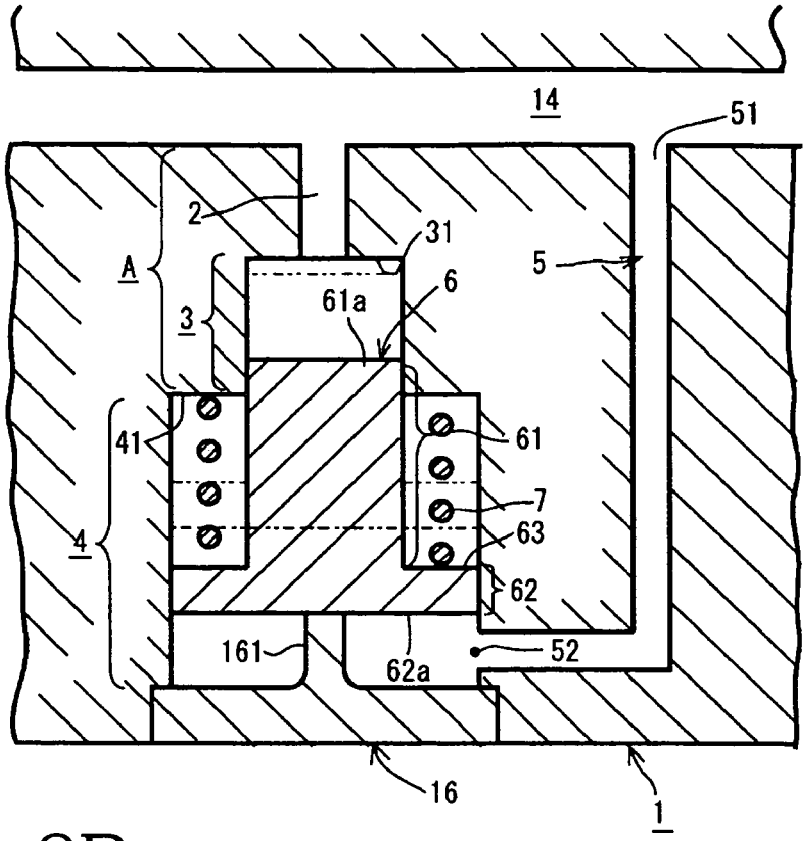
FIG. 8A is a vertical cross-section front-view diagram illustrating the constitution of a third embodiment of a resonator of the present invention.
Figure 8B:
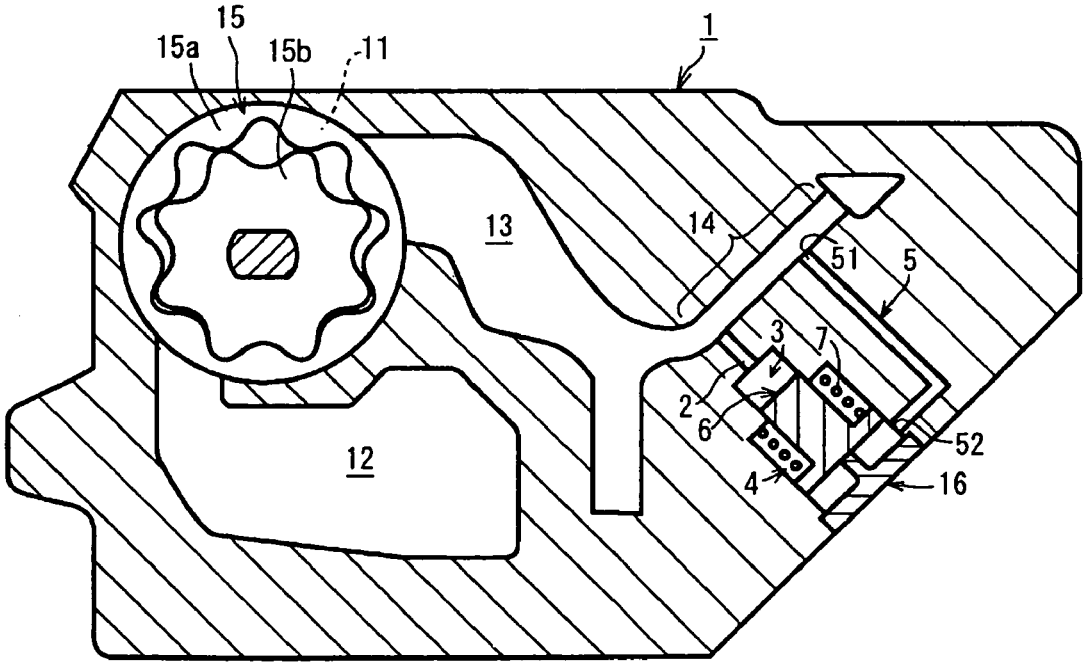
FIG. 8B is a schematic diagram illustrating the constitution of the resonator of the third embodiment when fitted in a pump housing.

As illustrated in FIG. 8A, the chamber 3 and the piston chamber 4 form a gap chamber of substantially cylindrical shape. The leading end face section 61*a* of the piston rod 61 of the piston 6 makes up one of the inner wall faces of the chamber 3. Sliding of the piston 6 causes the leading end face section 61*a* of the piston rod 61 to move up-and-down within the chamber 3, thereby varying the volume of the chamber 3. A step wall face 41 is formed at the boundary of the piston chamber 4 and the chamber 3 such that the step 63 of the piston 6 faces the step wall face 41. A spring 7 is provided between the piston rod 61 and the step wall face 41.

The spring used as the spring 7 is, specifically, a compression coil spring. The piston 6 is usually elastically urged in a direction that makes the volume of the chamber 3 larger. The rear face section 62*a* of the piston base 62 can receive the pressure of oil flowing from the branch channel 5 into the piston chamber 4. In order to make it easier for the rear face section 62*a* to receive the pressure oil flowing from the branch channel 5 into the piston chamber 4, the site at which the piston chamber 4 and the branch channel 5 communicate with each other is designed to lie at a position below the rear face section 62*a* of the piston 6. Specifically, a lid member 16 is fitted at the bottom of the piston chamber 4. A substantially solid-cylindrical stand 161, formed on the lid member 16, is disposed in the piston chamber 4 (FIG. 8A).

The stand 161 prevents the piston 6 from reaching the lowermost section of the piston chamber 4. The piston 6 is supported through abutting of the rear face section 62*a* thereof against the stand 161. The rear face section 62*a* of the piston 6 is positioned so as to lie above an inlet section 52 of the branch channel 5 into the piston chamber 4. The pressure flowing from the branch channel 5 flows into the piston chamber 4 via the inlet section 52, which is positioned lower than the rear face section 62*a*. Thus, substantially the entire surface of the rear face section 62*a* of the piston 6 can be uniformly compressed at all times.

An inlet opening 51 of the branch channel 5 onto the discharge flow channel 14 is preferably positioned more downstream in the discharge flow channel 14 than the introduction channel 2 (FIGS. 8 to 11). Herein, "downstream" in the discharge flow channel 14 refers to the opposite side of the side at which the discharge port 13 is provided, taking as a reference the position of the introduction channel 2. In the discharge flow channel 14, also, "upstream" denotes the side more toward the rotor chamber 11 than the introduction channel 2. The inlet opening 51 of the branch channel 5 onto the discharge flow channel 14 is positioned thus downstream of the introduction channel 2 in the discharge flow channel 14. As a result, pulsations W are reduced to a greater extent downstream in the discharge flow channel 14 than upstream. The piston, therefore, does not incur unwanted behavior to be caused by pulsations W, and hence the reciprocating motion operation of the piston 6 is made more reliable.

Thus the invention including all the above first through third embodiments (genus invention) comprises the discharge flow channel 14 communicating with the discharge port 13; the resonator A comprising the introduction channel 2, formed in the discharge flow channel 14, and the chamber 3 communicating with the introduction channel 2; and the piston 6, having a leading end face section 61*a* that makes up the inner wall face of the chamber 3, and reciprocating in response to pulsation changes; wherein the piston 6 slides so as to reduce the volume of the chamber 3 as the frequency distribution of the pulsations W becomes higher during pump operation.

The operation of the present invention is explained next. In the first embodiment, the piston 6 is fitted across both the piston chamber 4 and the chamber 3 of the resonator A. Specifically, the leading end of the piston rod 61, including the leading end face section 61*a*, is inserted into the chamber 3. Another portion of the piston 6, including the piston base 62, is disposed in the piston chamber 4. In the first and second embodiments, the piston 6 is moved reciprocally by the motor 8.

When the pump is working, oil flows from the rotor chamber 11 to the discharge flow channel 14 via the discharge port 13. When the frequency of the pulsations W that accompany oil flow is close to or about a frequency maximum, the motor 8 operates on the basis of signal information received from the rpm sensor 91, in such a manner that the spacing H between the top 31 of the chamber 3 and the leading end face section 61*a* of the piston 6 becomes smallest, to reduce the gap volume of the chamber 3 to a minimum (FIG. 3). That is, the chamber 3 becomes a minimum gap chamber, as a result of which pressure is reflected for the largest-frequency pulsations W. Reverse-phase pulsations W are thus generated through reflection of the pulsations W of oil entering into the chamber 3 via the introduction channel 2. This allows reducing, as a result, the pulsations W (FIG. 3B).

When the frequency of the pulsations W that accompany oil flow is close to or about a frequency minimum, the operation of the piston 6 is as follows. The frequency of the oil pulsations W is small and the pump rotor rotates slowly. Therefore, the flow rate of oil is slow, and oil pressure stands at its lowest (FIG. 4). For the piston 6, the motor 8 operates on the basis of signal information received from the rpm sensor 91, in such a manner that the spacing H between the top 31 of the chamber 3 and the leading end face section 61*a* of the piston 6 becomes largest, whereby the gap volume of the chamber 3 becomes maximum.

That is, the chamber 3 becomes a maximum gap chamber, as a result of which pressure is reflected for the smallest-frequency pulsations W. Reverse-phase pulsations W are thus generated through reflection of the pulsations W of oil entering into the chamber 3 via the introduction channel 2. This allows reducing, as a result, the pulsations W. FIG. 5 illustrates the position of the piston 6 in the chamber 3 and the piston chamber 4 when the oil has a smallest-frequency pulsation W, when the oil has a largest-frequency pulsation W, and when the oil has a pulsation W of intermediate frequency. The volume of the gap of the chamber 3 is an intermediate (or substantially intermediate) volume between the volume of the chamber 3 for the largest pulsation W, and the volume of the chamber 3 for the smallest pulsation W.

As described above, the larger the volume of the chamber 3 of the resonator A, the lower the frequencies of the pulsations W that can be reduced, while the smaller the volume of the chamber 3 of the resonator A, the higher the frequencies of the pulsations W that can be reduced. In the above structure, therefore, the chamber 3 of the resonator A is larger during low revolutions, which allows reducing low-frequency pulsations W corresponding to low pump revolutions. During high pump revolutions, the chamber 3 of the resonator A is smaller, which allows reducing high-frequency pulsations W corresponding to high pump revolutions. Thanks to the reciprocating motion of the piston 6 based on the detection by the rpm sensor 91 of the engine 100, pulsations W can thus be reduced over a wide frequency range, with the volume of the chamber 3 of the resonator A being continuously variable. This elicits, as a result, the effect of reducing the pulsations W over a wide range of frequencies "across the board" using a single resonator A, and not the effect of reducing pulsations W of a specific frequency, pinpoint-like, at various locations of the discharge flow channel 14.

In the second embodiment, the displacement of the piston 6 can be determined by controlling the revolutions of the motor 8 on the basis of the oil pressure detected by the pressure sensor 92 and that is sent by the latter, as an information signal, to the motor 8, such that the volume of the chamber 3 can be suitably set for respective pulsations W (FIGS. 6 and 7).

In the third embodiment, the piston 6 is usually elastically urged, by a spring 7, in a direction that makes the volume S of the chamber 3 larger. The piston 6 is set to be positioned at an appropriate height, by way of the stand 161 of the lid member 16, in such a manner that the rear face section 62*a* of the piston 6 lies above the inlet section 52 of the branch channel 5 into the piston chamber 4. The pressure P flowing into that communicating portion is distributed towards the rear face section 62*a*, whereby the piston 6 can easily receive the pressure P (FIG. 8).

Figure 9A:
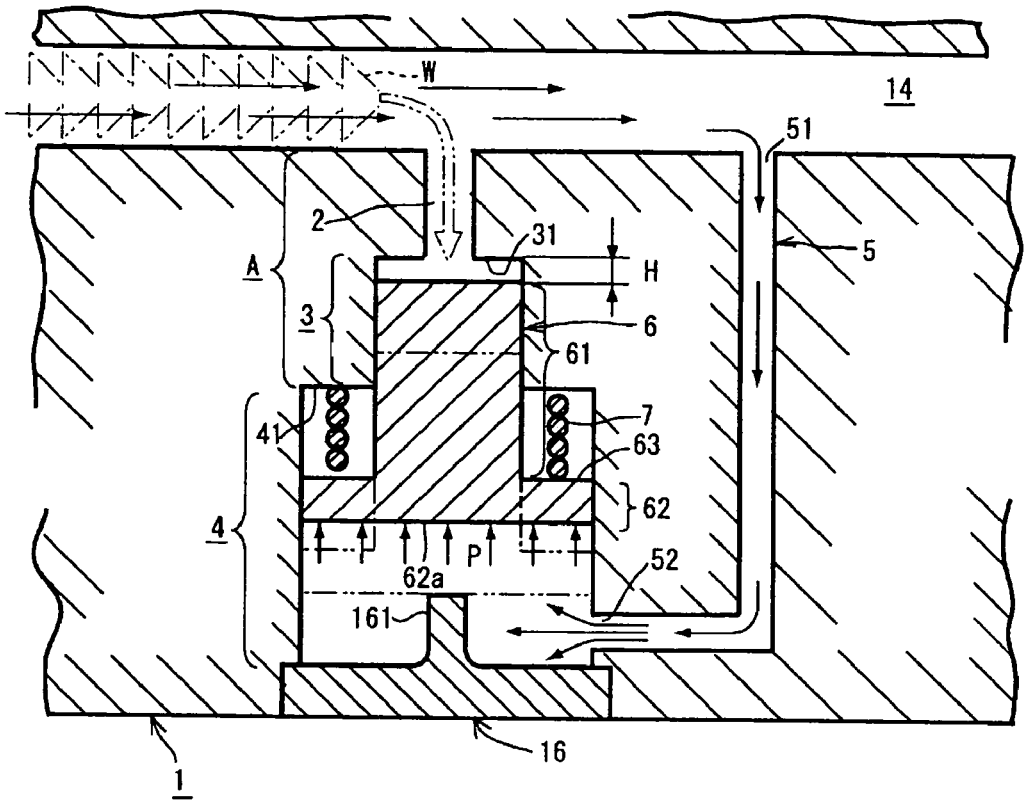
FIG. 9A is a vertical cross section front-view diagram of the third embodiment, illustrating the resonator of the third embodiment when oil having a pulsation of a highest frequency flows into a discharge flow channel.
Figure 9B:
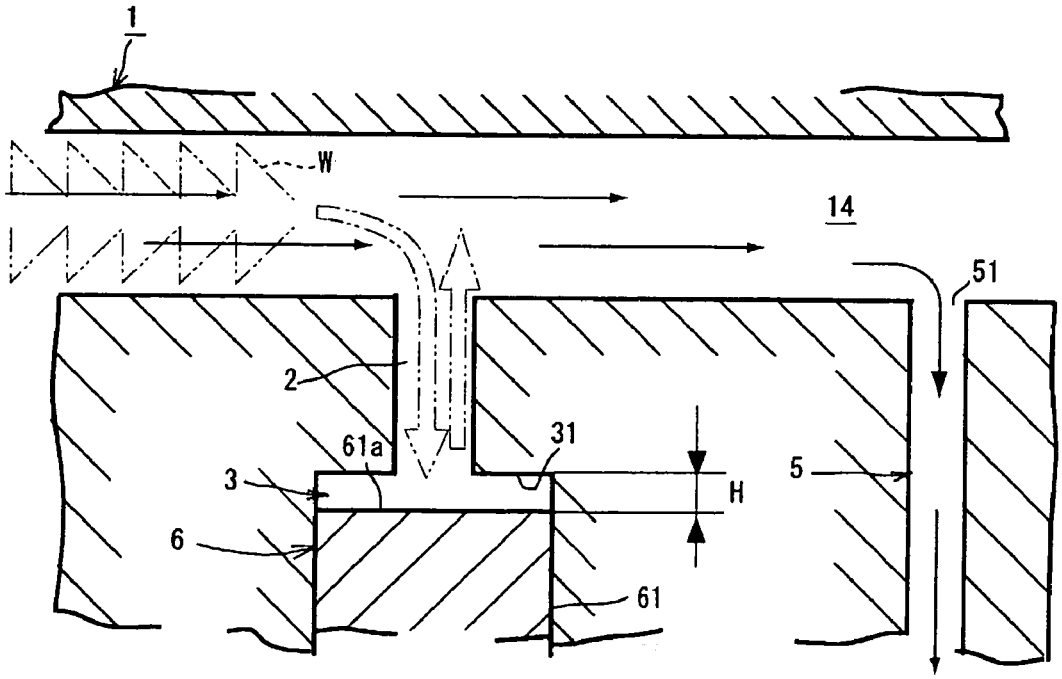
FIG. 9B is an enlarged-view diagram of a characterizing portion of FIG. 9A.

When the pump is working, oil flows from the rotor chamber 11 to the discharge flow channel 14 via the discharge port 13. When the frequency of the pulsations W that accompany oil flow is close to or about a frequency maximum, the piston 6 is operated as follows (FIG. 9). In the third embodiment, oil pressure flows into the piston chamber 4 via the branch channel 5. When the frequency of the oil pulsations W is large, the pump rotor rotates fast. Therefore, oil flow is fast, oil pressure becomes highest, and the pressure P becomes extremely high. The pressure P acts on the rear face section 62*a* of the piston 6, overcoming the elastic force of the spring 7, and raising thereby the piston 6 to an uppermost position. At this time, the spacing H between the top 31 of the chamber 3 and the leading end face section 61*a* of the piston 6 becomes minimal, as does the gap volume of the chamber 3. That is, the chamber 3 becomes a minimum gap chamber, as a result of which pressure is reflected for the largest-frequency pulsations W. Reverse-phase pulsations W are thus generated through reflection of the pulsations W of oil entering into the chamber 3 via the introduction channel 2. This allows reducing, as a result, the pulsations W (FIG. 9B).

Figure 10A:
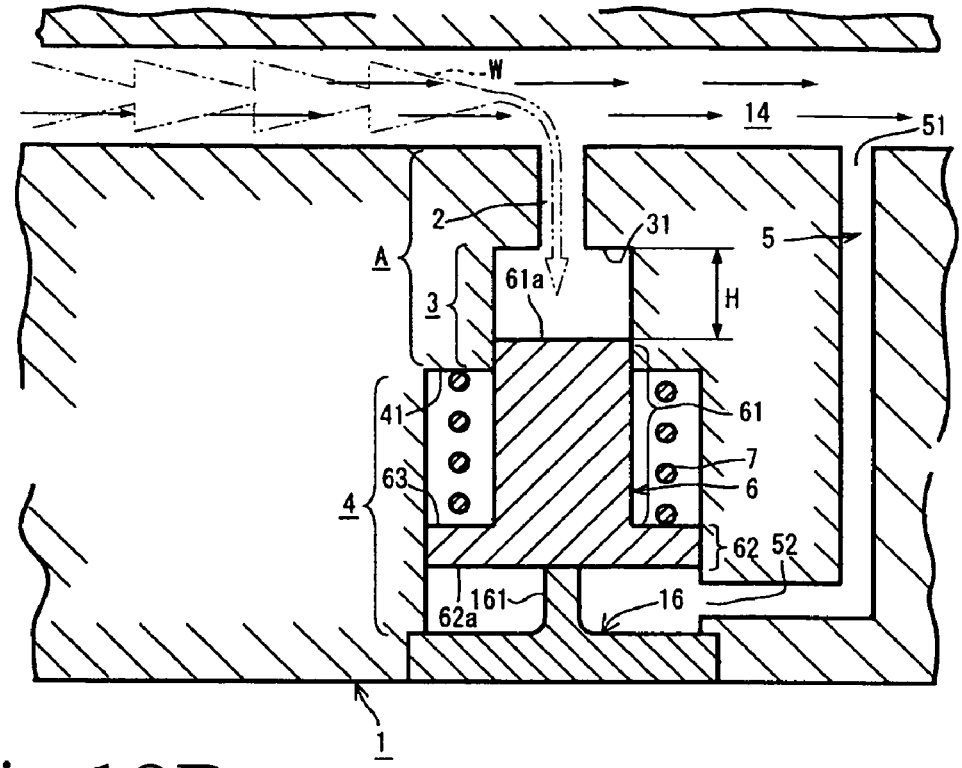
FIG. 10A is a vertical cross section front-view diagram of the third embodiment, illustrating the resonator of the third embodiment when oil having a pulsation of a lowest frequency flows into the discharge flow channel.
Figure 10B:
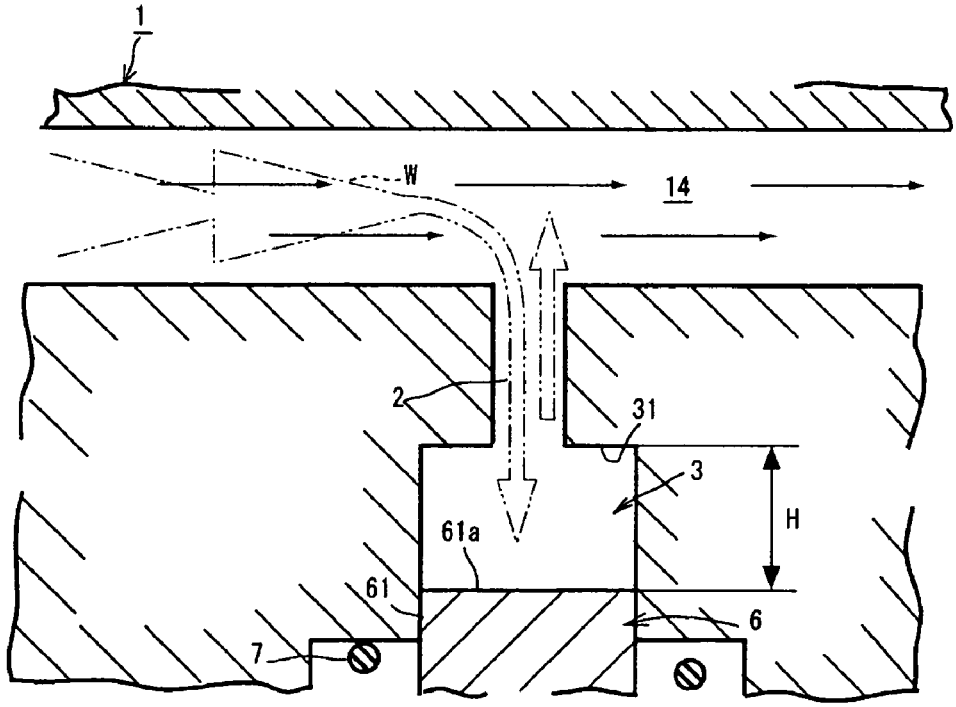
FIG. 10B is an enlarged-view diagram of a characterizing portion of FIG. 10A.

When the frequency of the pulsations W that accompany oil flow are close to or around a frequency minimum, the piston 6 operates as follows (FIG. 10). Firstly, oil pressure flows into the piston chamber 4 via the branch channel 5, as described above. The frequency of the oil pulsations W is small and the pump rotor rotates slowly. Therefore, the flow rate of oil is slow, and oil pressure stands at its lowest. The pressure P received by the rear face section 62*a* becomes then very small. The pressure P is now smaller than the elastic force of the spring 7, and thus the piston 6 remains immobile at a lowermost position. At this time, the spacing H between the top 31 of the chamber 3 and the leading end face section 61*a* of the piston 6 becomes maximal, as does the gap volume of the chamber 3.

Figure 11A:
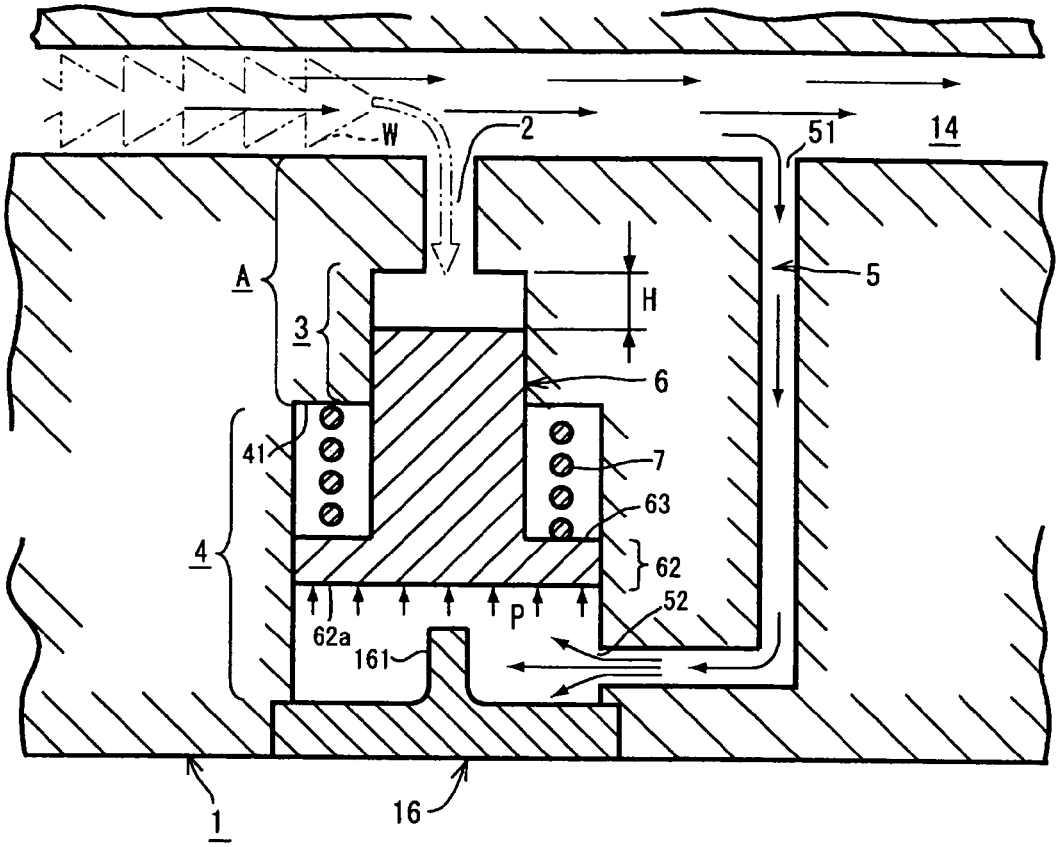
FIG. 11A is a vertical cross section front-view diagram of the third embodiment, illustrating the resonator of the third embodiment when oil having a pulsation of an intermediate frequency flows into the discharge flow channel.
Figure 11B:
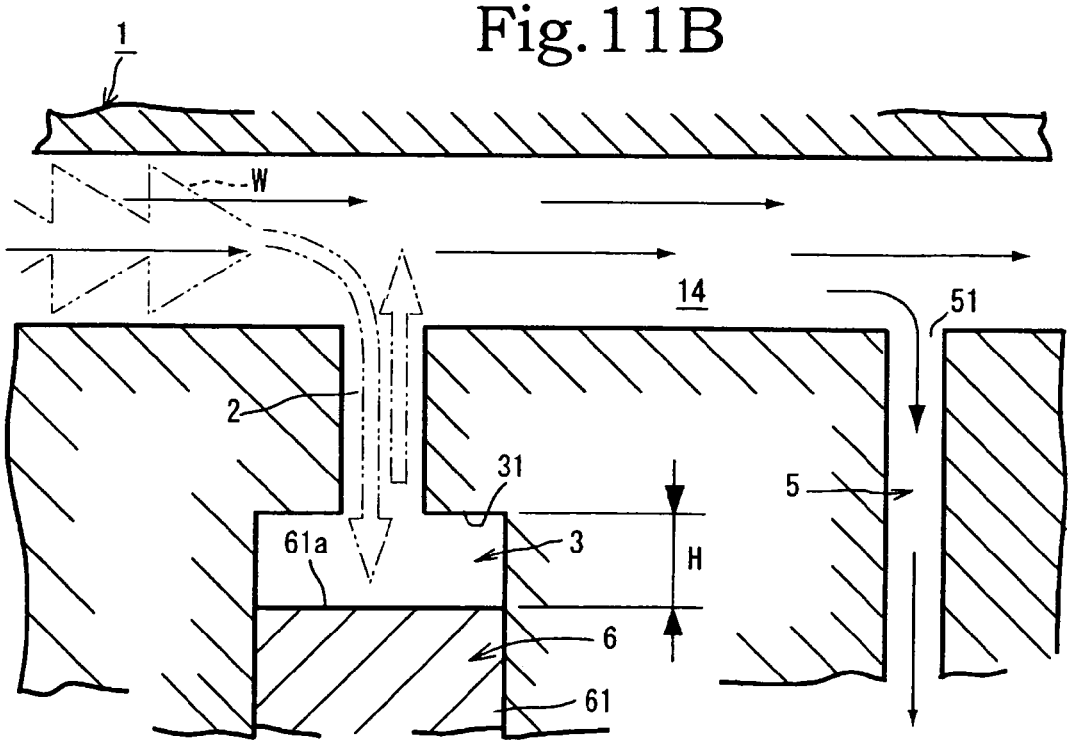
FIG. 11B is an enlarged-view diagram of a characterizing portion of FIG. 11A.

That is, the chamber 3 becomes a maximum gap chamber, as a result of which pressure is reflected for the smallest-frequency pulsations W. Reverse-phase pulsations W are thus generated through reflection of the pulsations W of oil entering into the chamber 3 via the introduction channel 2. This allows reducing, as a result, the pulsations W. FIG. 11 illustrates the position of the piston 6 in the chamber 3 and the piston chamber 4 when the oil has a smallest-frequency pulsation W, when the oil has a largest-frequency pulsation W, and when the oil has a pulsation W of intermediate frequency.

The rear face section 62*a* of the piston 6 receives the pressure P, the pressure P being balanced through some compression of the spring 7. The volume of the gap of the chamber 3 is an intermediate (or substantially intermediate) volume between the volume of the chamber 3 for the largest pulsation W, and the volume of the chamber 3 for the smallest pulsation W.

By virtue of the relationship "pressure (force per unit surface area)×surface area=overall force", as the discharge pressure of the discharge port 13 increases, the discharge pressure causes the piston 6 to overcome the load of the spring 7, as an urging member, and to move in the direction in which the chamber 3 of the resonator A shrinks. In the above structure, the volume of the chamber 3 of the resonator A increases during pump low revolutions (during low discharge pressure), and decreases during pump high revolutions (high discharge pressure).

As described above, low-frequency pulsations W can be reduced as the volume of the chamber 3 of the resonator A becomes larger, while high-frequency pulsations W can be reduced as the volume of the chamber 3 of the resonator A becomes smaller.

In the above structure, therefore, the chamber 3 of the resonator A is larger during low revolutions, which allows reducing low-frequency pulsations W, corresponding to low pump revolutions. During high pump revolutions, the chamber 3 of the resonator A is smaller, which allows reducing high-frequency pulsations W corresponding to high pump revolutions. The pulsations W can thus be reduced over a wide frequency range in response to pump revolutions, with the volume of the chamber 3 of the resonator A being continuously variable. This elicits, as a result, the effect of reducing the pulsations W over a wide range of frequencies "across the board" using a single resonator A, and not the effect of reducing pulsations W of a specific frequency, pinpoint-like, at various locations of the discharge flow channel 14.

Figure 12:
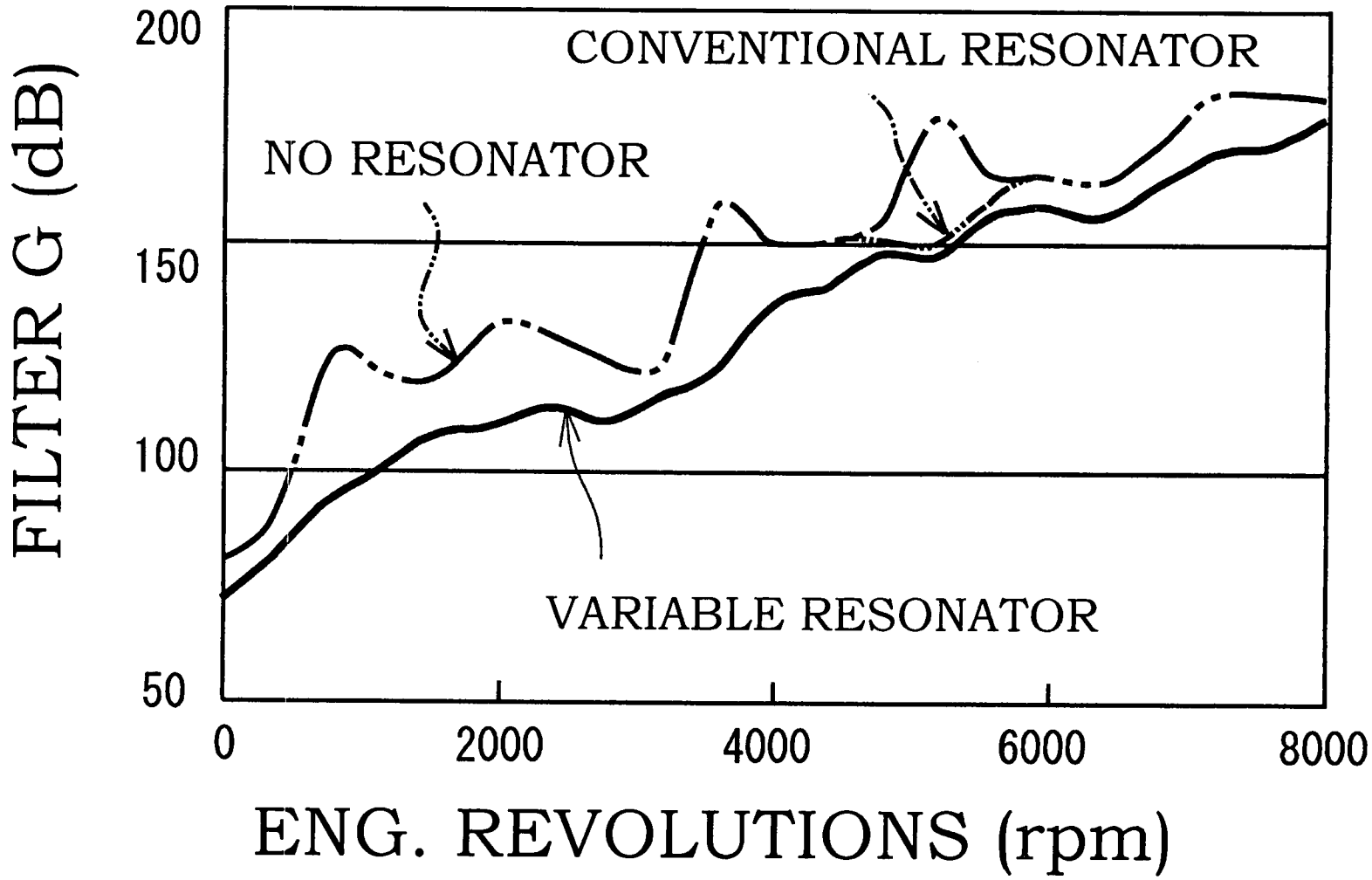
FIG. 12 is a graph illustrating a comparison between the characteristics of a pump comprising a resonator of the present invention, a pump not comprising the resonator of the present invention, and a pump comprising a conventional resonator.

FIG. 12 is a graph illustrating characteristics of the present invention. The graph depicts comparatively the characteristic curves of an oil pump comprising the resonator A of the present invention, an oil pump not comprising the resonator A of the present invention, and an oil pump having a conventional resonator. The graph shows that the pulsations W in an oil pump having the resonator A of the present invention are reduced over a wide range of revolutions. The graph shows also that pulsations are reduced to a very narrow extent, and only in a specific region of the frequency distribution, in the oil pump having a conventional resonator.

What is claimed is:

1. An oil pump resonator, in an engine oil pump for feeding oil from a suction port to a discharge port through rotation of a rotor fitted in a pump housing, provided with: a discharge flow channel communicating with the discharge port; a resonator comprising an introduction channel formed in the discharge flow channel, and a chamber communicating with the introduction channel; and a piston having a leading end face section that makes up an inner wall face of the chamber, and reciprocating in response to pulsation changes, the piston being configured to slide so as to reduce the volume of the chamber as the frequency distribution of the pulsations becomes higher.

2. An oil pump resonator, in an engine oil pump for feeding oil from a suction port to a discharge port through rotation of a rotor fitted in a pump housing, provided with: a discharge flow channel communicating with the discharge port; a resonator comprising an introduction channel formed in the discharge flow channel, and a chamber communicating with the introduction channel; and a piston having a leading end face section that makes up an inner wall face of the chamber, and sliding on the basis of detected revolutions of the engine, the piston being configured to slide so as to reduce the volume of the chamber as the revolutions of the engine increase.

3. An oil pump resonator, in an engine oil pump for feeding oil from a suction port to a discharge port through rotation of a rotor fitted in a pump housing, provided with: a discharge flow channel communicating with the discharge port; a resonator comprising an introduction channel formed in the discharge flow channel, and a chamber communicating with the introduction channel; and a piston having a leading end face section that makes up an inner wall face of the chamber, and sliding in response to oil pressure changes, the piston being configured to slide so as to reduce the volume of the chamber as oil pressure increases in the discharge flow channel.

4. The oil pump resonator according to claims 1, wherein a motor causes the piston to reciprocate within the chamber.

5. The oil pump resonator according to any one of claims 2, wherein a motor causes the piston to reciprocate within the chamber.

6. The oil pump resonator according to any one of claims 3, wherein a motor causes the piston to reciprocate within the chamber.

7. The oil pump resonator according to claim 4, wherein the motor is operated by an engine rpm sensor.

8. The oil pump resonator according to claim 5, wherein the motor is operated by an engine rpm sensor.

9. The oil pump resonator according to claim 6, wherein the motor is operated by an engine rpm sensor.

10. The oil pump resonator according to claim 4, wherein the motor is operated by a pressure sensor that detects pressure in the discharge flow channel.

11. The oil pump resonator according to claim 5, wherein the motor is operated by a pressure sensor that detects pressure in the discharge flow channel.

12. The oil pump resonator according to claim 6, wherein the motor is operated by a pressure sensor that detects pressure in the discharge flow channel.

13. The oil pump resonator according to claim 10, wherein the pressure sensor detects pressure at a position more downstream in the discharge flow channel than an inlet opening of the introduction channel.

14. The oil pump resonator according to claim 11, wherein the pressure sensor detects pressure at a position more downstream in the discharge flow channel than an inlet opening of the introduction channel.

15. The oil pump resonator according to claim 12, wherein the pressure sensor detects pressure at a position more downstream in the discharge flow channel than an inlet opening of the introduction channel.

16. The oil pump resonator according to claim 3, comprising a piston chamber adjacent to the chamber, wherein the piston comprises: a piston rod having the leading end face section, and a piston base having a rear face section having a larger surface area than the leading end face section, the piston chamber communicating with the discharge flow channel via a branch channel such that oil pressure acts on the rear face section, and the piston is usually elastically urged in a direction that makes the volume of the chamber larger.

17. The oil pump resonator according to claim 16, wherein an inlet opening of the branch channel is positioned more downstream in the discharge flow channel than the introduction channel inlet opening.

* * * * *